US005749524A

United States Patent [19]

Roman

[11] Patent Number: 5,749,524

[45] Date of Patent: May 12, 1998

[54] SIDE DRIVING ELEMENT FOR AN IRRIGATION DEVICE WITH AN OSCILLATING ARM

[75] Inventor: Gianfranco Roman, Pasiano (Pordenone), Italy

[73] Assignee: Claber S.p.A., Fiume Veneto (Pordenone), Italy

[21] Appl. No.: 580,520

[22] Filed: Dec. 28, 1995

[30] Foreign Application Priority Data

Jan. 3, 1995 [IT] Italy ..... MI95002 U

[51] Int. Cl.[6] ..... B05B 3/04

[52] U.S. Cl. ..... 239/240; 239/242; 239/246; 239/DIG. 1

[58] Field of Search ..... 239/237, 240, 239/241, 242, 246, 264, DIG. 1

[56] References Cited

U.S. PATENT DOCUMENTS

| | | | |
|---|---|---|---|
| 1,479,675 | 1/1924 | Rees | 239/242 |
| 2,932,457 | 4/1960 | Ballard | 239/242 |
| 4,218,017 | 8/1980 | Gianfranco | 239/242 |
| 4,232,827 | 11/1980 | Roman | 239/242 |
| 4,245,786 | 1/1981 | Abrahamsen et al. | 239/242 |
| 4,457,471 | 7/1984 | Roman | 239/242 |
| 4,721,248 | 1/1988 | Chow | 239/242 |
| 5,052,622 | 10/1991 | Lindermeir et al. | 239/242 |
| 5,562,247 | 10/1996 | Roman | 239/240 |

FOREIGN PATENT DOCUMENTS 2 032 745 5/1980 United Kingdom .

*Primary Examiner*—Andres Kashnikow
*Assistant Examiner*—Lisa Ann Douglas
*Attorney, Agent, or Firm*—Nixon & Vanderhye, P.C.

[57] ABSTRACT

A side driving element for an irrigation device with an oscillating arm comprises a casing. Inside the casing there is rotatably housed a turbine rotor having an axis of rotation parallel to that of the oscillating arm of the irrigation device. The rotor powers the oscillating arm. An external mouth connects to a supply conduit of an irrigation liquid. The mouth has an axis lying in a plane orthogonal to the axis of rotation of the rotor, and communicates with an internal rectilinear conduit aligned with the mouth and directed toward the rotor, so that a jet of irrigation liquid supplied by said supply conduit is not subjected to deviations before reaching the rotor.

10 Claims, 4 Drawing Sheets

SIDE DRIVING ELEMENT FOR AN IRRIGATION DEVICE WITH AN OSCILLATING ARM

BACKGROUND

I. Field of the Invention

The present invention relates to a side driving element for an irrigation device with an oscillating arm.

II. Related Art and Other Considerations

In the sector of gardening articles, irrigation devices with an oscillating arm are known. Such irrigation devices comprise an arm hollow internally having water diffusion nozzles, rotatably fastened at its ends to two supporting side elements, that are also connected together, substantially opposite their support bases, by a pair of stems. One of the two side elements (hereinafter called "driving side element") is provided inside it with a turbine mechanism for operating the arm. The turbine is driven by the same water that is later supplied to the oscillating arm.

Inside the driving side element, the turbine rotor has an axis of rotation parallel to the axis of rotation of the arm. Such axis coincides with the longitudinal axis of the irrigation device. The driving side element is also provided with a water-supply mouth, to which a pipe is connected. Such pipe is connected in turn connected to the water mains. In known irrigation devices such mouth has an axis parallel to the axis of rotation of the turbine, that is it extends longitudinally to the irrigation device. This means that the jet of water entering the driving side element through the supply mouth must be deflected by about 90° before going on to impinge on the rotor's vanes, which determines a loss of head and thus a loss of power of the turbine. In addition, the dimensions of the irrigation device in the longitudinal direction are increased due to the fact that the delivery mouth extends longitudinally to the irrigation device itself.

In view of the state of the art described, the object of the present invention is to provide a driving side element for an irrigation device with an oscillating arm that solves the abovementioned problems.

SUMMARY

According to the present invention, such object is achieved thanks to a driving side element for an irrigation device with an oscillating arm. The device comprises a casing inside which there is rotatably housed a turbine rotor having an axis of rotation parallel to that of the oscillating arm of the irrigation device, said rotor driving operating means of the oscillating arm, and an external mouth for connecting a supply conduit of an irrigation liquid. The device is characterized in that the mouth has an axis lying in a plane orthogonal to the axis of rotation of the rotor, and communicates with an internal rectilinear conduit aligned with the mouth and directed toward said rotor, so that a jet of irrigation liquid supplied by said supply conduit is not subjected to deviations before reaching said rotor.

Preferably, the internal conduit is conical with a cross-section that decreases from the external mouth toward the rotor, so that the speed of the irrigation liquid increases to obtain an increase of energy.

Thanks to the present invention, and in particular thanks to the fact that the external mouth for the supply of water extends perpendicularly to the axis of rotation of the rotor, it is possible to obtain a driving side element for an irrigation device with an oscillating arm wherein the jet of water that drives the rotor of the turbine is not subjected to deviations, and is thus not subject to losses of head and thus to any waste of energy. In addition, since the external mouth for the supply of water extends perpendicularly to the axis of rotation of the irrigation device, the dimensions of the latter are reduced.

BRIEF DESCRIPTION OF THE DRAWINGS

These and other features and advantages of the present invention will be made more evident by the following detailed description of an embodiment thereof, described as a non-limiting example with reference to the enclosed drawings, wherein.

DETAILED DESCRIPTION OF THE DRAWINGS

With reference to the drawings, a driving side element according to the present invention for an irrigation device with an oscillating arm comprises a casing 1 in plastic material, comprising two parts 2 and 3, housing 2 and cover 3, respectively, of the casing 1.

Figure 4:
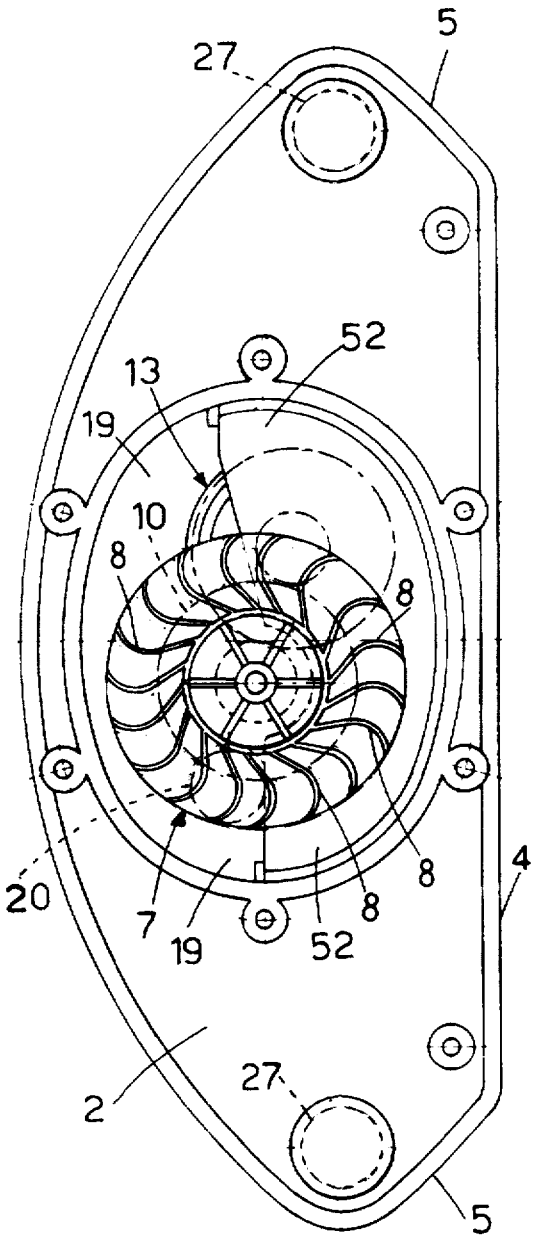
FIG. 4 shows the side element in a view similar to FIG. 2, but with no cover.

The housing 2 of the casing 1 has a flat supporting base 4, that at its ends has two oblique sections 5 for connecting to an arched upper part (FIG. 4).

Figure 2:
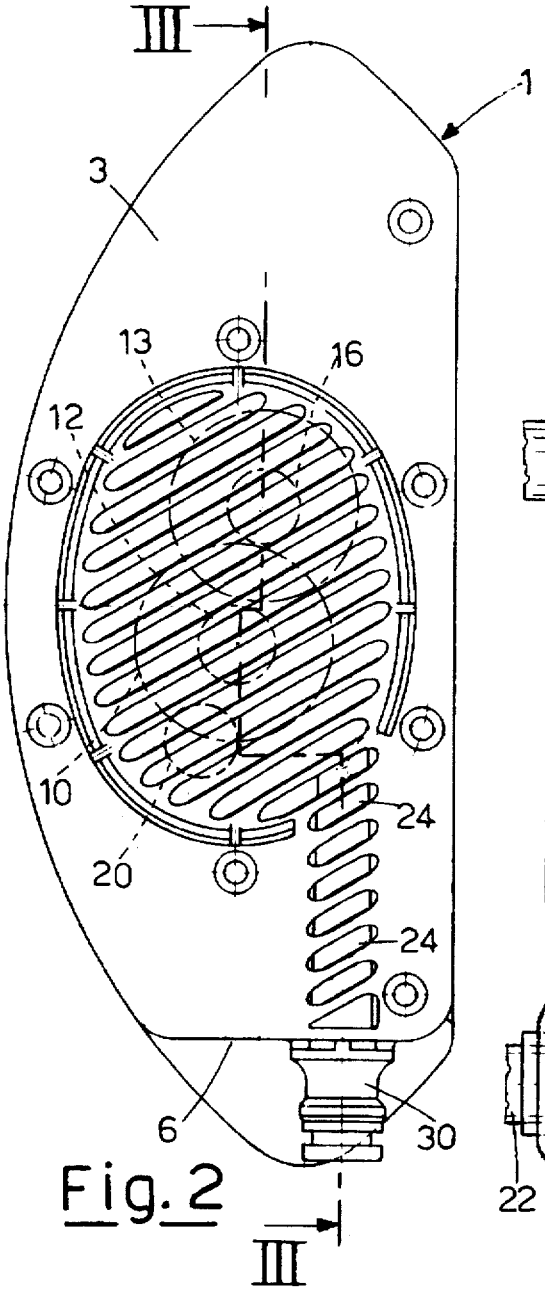
FIG. 2 is a side view from the right hand side of the side element of FIG. 1.
Figure 1:
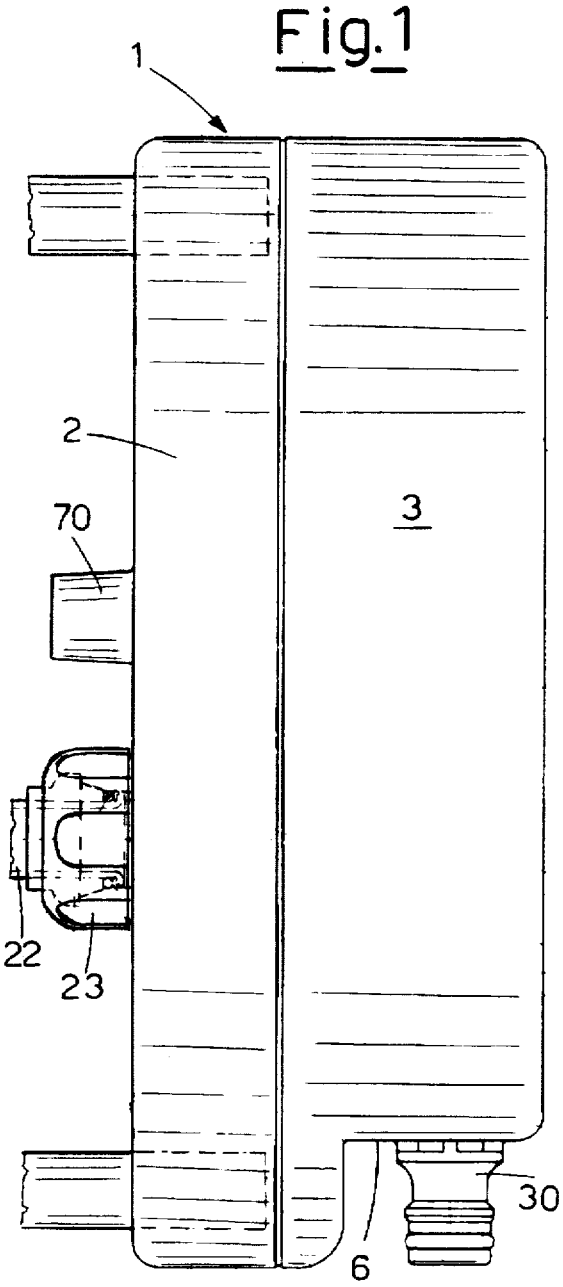
FIG. 1 is a plan view from above of a driving side element for an irrigation device according to the invention.
Figure 6:
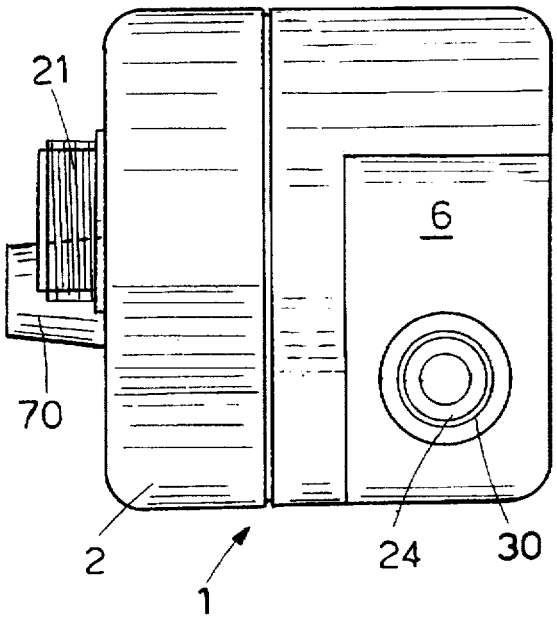
FIG. 6 is a front view of the element of FIG. 1.
Figure 3:
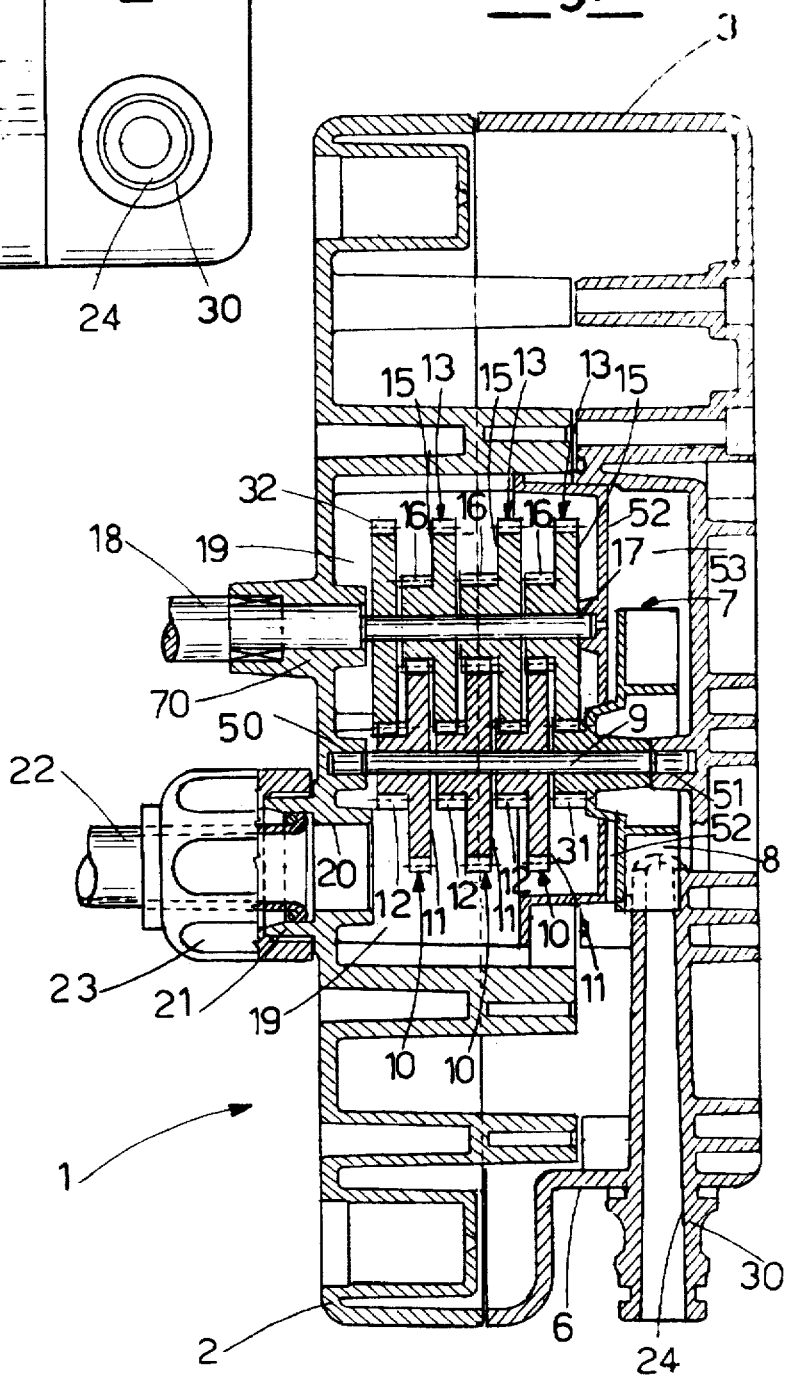
FIG. 3 is a cross-sectional view taken along the line III—III of FIG. 2.
Figure 5:
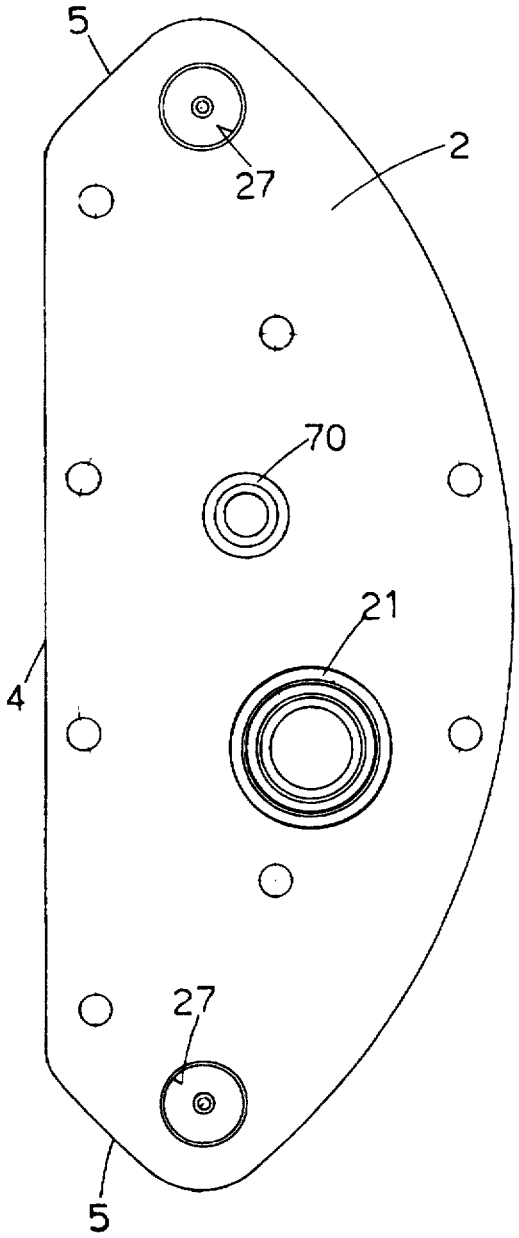
FIG. 5 is a side view from the left hand side of the side element of FIG. 1.

The cover 3 has substantially the same shape as the housing 2, but in addition it has a vertical discharge defining a niche 6 opposite which there protrudes, in a direction orthogonal to the vertical discharge itself, a supply mouth 30 (FIGS. 1–3). As can be seen in the drawings, the supply mouth 30 does not increase the dimensions of the casing 1, as it does not protrude from the external perimeter of the casing 1 itself.

The cover 3 can be fastened to the housing 2 both removably by means of bolts (to allow the cover to be opened), or, less expensively, in a non-removable manner, by means of welding.

As shown in FIGS. 3 and 4, in a chamber 53 obtained inside the casing 1 there is rotatably housed a rotor 7 of a water turbine. Rotor 7 is provided with a plurality of spoon-type vanes 8, and is integral with a shaft 9 hinged at the ends in two seats 50 and 51 provided in the housing 2 and in the cover 3, respectively, of the casing 1. The axis of rotation of the shaft 9 is parallel to the axis of rotation of an oscillating arm 22 (only a portion of which can be seen in FIG. 3) of the irrigation device.

To the shaft 9 there are also fastened integrally three toothed wheels 10, each comprising a toothed crown 11 having a larger diameter and a toothed crown 12 having a smaller diameter. Rotor is also provided, in a position opposite to the vanes, with a toothed wheel with crown 31 having a diameter equal to that of crowns 12. The toothed wheels 10 mesh with three toothed wheels 13 integral with a second shaft 14. The toothed wheels 13 also comprises a toothed crown 15 having a larger diameter and a toothed crown 16 having a smaller diameter. The crown 12 with a diameter smaller than the toothed end wheel 10 mesh with a toothed wheel 32 integral with the second shaft 14. The second shaft 14 is rotatably housed at one end in a seat 17, while at the other end it is fastened to a hub 18, rotatably housed in a cylindrical projection 70, that transmits the motion to a device for moving the arm (for example of the type shown in FIGS. 7 and 8, and that will be described later). The toothed crowns of the toothed wheels 10 and 13 have teeth spaced sufficiently apart to avoid being jammed as a result of calcareous water deposits or of infiltrations of dirt.

The gears constituted by the toothed wheels 10 and 13 are housed in a chamber 19 located to the rear of rotor 7, and in which there is a hole 20 that extends outward to form a threaded sleeve 21 (FIG. 3). The oscillating arm 22 is rotatably inserted in the hole 20. Ring nut 23, screwed on to the sleeve 21, prevents the arm 22 from slipping off. The chamber 19 is separated from chamber 53 of rotor 7 by a substantially semicircular diaphragm 52: the two chambers 19 and 53 thus communicate one with the other. Water from the supply mouth 30, at a certain pressure (pressure of the water mains to which the irrigation device is connected through a supply conduit not shown), is made to flow, through a rectilinear conical conduit 24 provides in the cover 3 of the casing 1, toward rotor 7 of the turbine where, acting on vanes 8 (that are struck substantially perpendicularly to their extension), it determines the rotation of the rotor 7 itself, and thus of shaft 9. The conical shape with decreasing cross-section of the conduit 24 determines an increase in the speed of the water, and thus an increase in the energy useful for driving the rotor. The toothed wheels 10, 31, 13 and 32 transmit the motion of shaft 9 to shaft 14, and thus to hub 18. The motion of the rotor is thus transmitted to the device for driving the arm 22. The water then flows into chamber 19, and from here inside the (hollow) arm of the oscillating arm 22.

Figure 7:
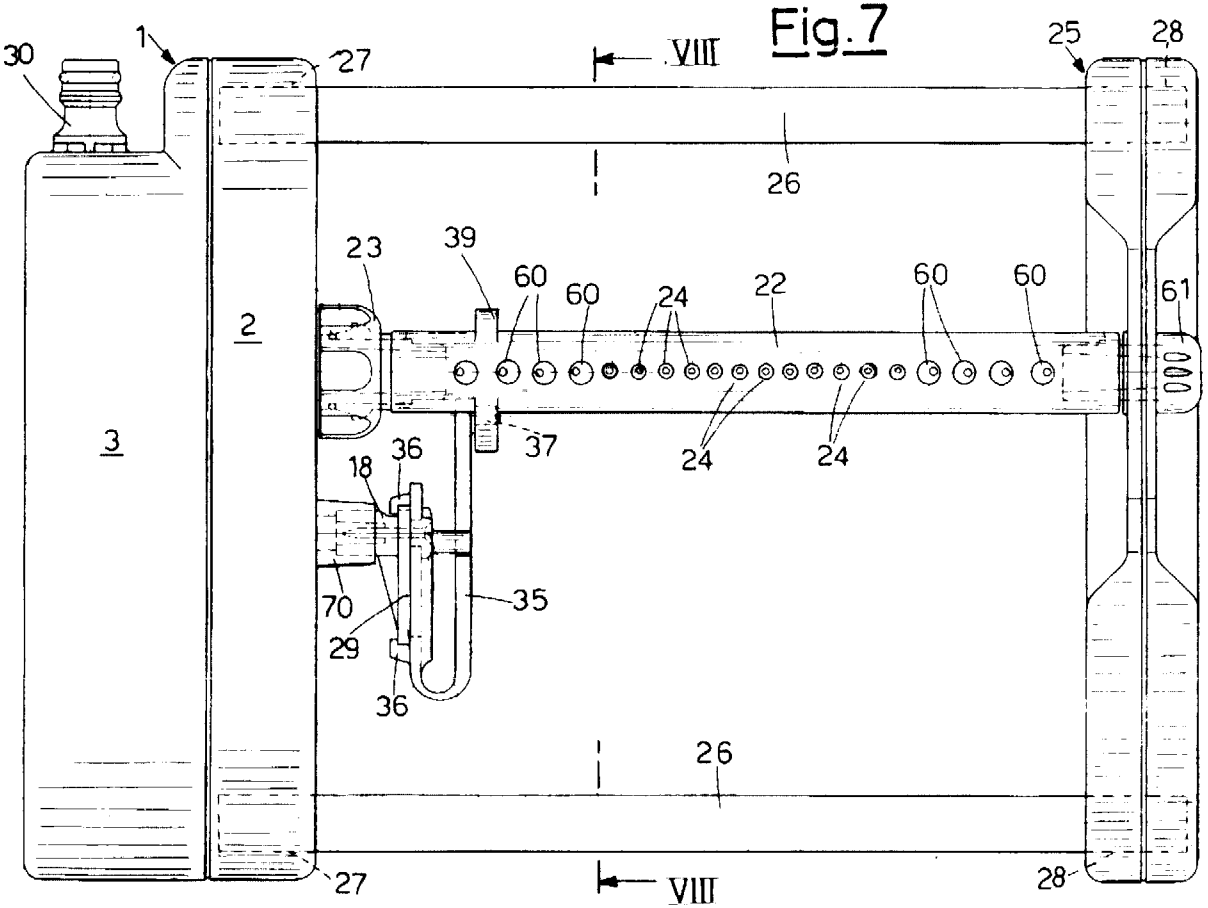
FIG. 7 is a plan view from above of an irrigation device with an oscillating arm that uses the driving side element according to the present invention.
Figure 8:
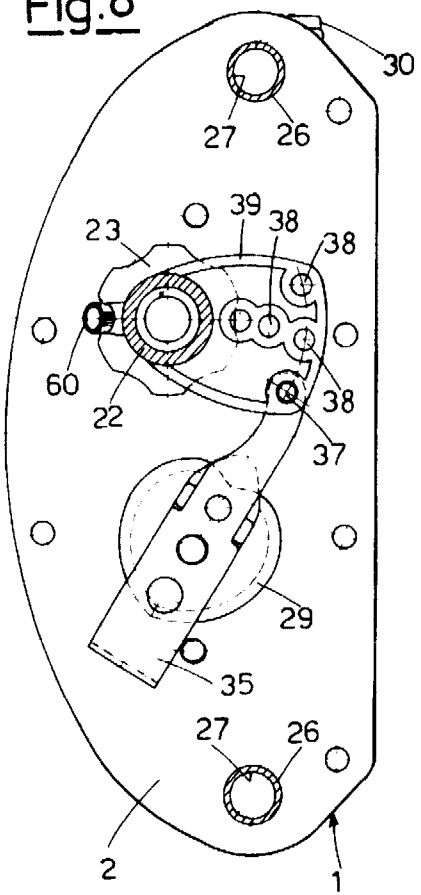
FIG. 8 is a cross-sectional view taken along the line VIII—VIII of FIG. 7.

An example of an irrigation device with an oscillating arm using the driving side element according to the present invention is shown in FIGS. 7 and 8. The irrigation device comprises a rectilinear oscillating arm 22 (substantially a cylinder) that in its upper part has a longitudinal succession of holes 24 for water to issue from the device. Nozzles 60 are housed in some of the holes 24. The arm 22 extends from the driving side element previously described to an opposite end side element 25, to which the arm 22 is rotatably fastened by means of a bolt 61. The side element 25, in a manner similar to the driving side element 1, is provided with a flat supporting base at whose ends there are oblique sections for connecting to an arched upper part. The two elements 1 and 25 are in addition connected by a pair of stems 26 inserted under pressure in holes 27 and 28 in the side elements 1 and 25, respectively, at a height of the supporting bases substantially corresponding to the connection of the oblique sections with the arched upper parts. In this way, the stems 26 are raised slightly above the supporting bases of the side elements 1 and 25, thus allowing the user to grasp the irrigation device more easily when it has to be moved (FIG. 8).

The device for driving the arm 22, that constitutes the object of a simultaneous application for a utility model patent in the name of the same applicant, comprises a cam 29 in the shape of a heart integral with hub 18, and that thus rotates together with the latter. On cam 29 there is a connecting rod 35, linked with the periphery of cam 29 by means of two hooks 36 that also act as a shoe. The connecting rod 25 is also provided at one end with a pin 37 that can be introduced in one of several holes 38 in a flange 39 integral with arm 22. The rotation of cam 29 determines a translatory movement of the connecting rod 35, that in turn determines the oscillation of arm 22. When the hole 38 linking connecting rod 35 to flange 39 is changed, it is possible to vary the amplitude of the oscillations of arm 22.

It should be highlighted that the driving side element according to the present invention can be used in combination with traditional oscillating arms and connecting stems 26. For example, it is possible to use the driving side element according to the present invention in irrigation devices having an arched arm, of the type described in simultaneously filed U.S. patent application Ser. No. 08/580,334.

I claim:

1. A side driving element for an irrigation device with an oscillating sprinkling arm, comprising:

a casing having a bottom wall forming a flat resisting plane arranged for sliding movement, a top wall and two side walls, the oscillating arm extending from one of the two side walls, a turbine rotor being housed inside said casing, the turbine rotor having an axis of rotation parallel to that of the oscillating arm of the irrigation device, said rotor driving the oscillating arm, and an external mouth extending from said casing in a position close to said resting plane for connecting a supply conduit of an irrigation liquid, wherein said mouth has an axis parallel to said resting plane and orthogonal to the axis of rotation of the rotor, the mouth communicating with an internal rectilinear conduit aligned with said mouth and directed toward said rotor, so that a fully rectilinear liquid supply path extends from said external mouth to said rotor.

2. A slide element according to claim 1, characterized in that inside said casing there are means for the transmission of the motion of the rotor to a rotating hub of a driving means of the oscillating arm.

3. A side element according to claim 2, characterized in that said means for the transmission of motion comprise three first toothed wheels, integral with a first shaft integral with said rotor, and three second toothed wheels, integral with a second shaft integral with said hub.

4. A side element according to claim 3, characterized in that each of said first and second toothed wheels comprises a first toothed crown having a larger diameter and a second toothed crown having a smaller diameter, the first toothed crown of each first toothed wheel meshing with a second toothed crown of a respective second toothed wheel, and the second toothed crown of each first toothed wheel meshing with the first toothed crown of said respective second toothed wheel.

5. A side element according to claim 2, characterized in that said rotor is housed in a first chamber wherein there extends said internal conduit and that communicates with a second chamber wherein there are housed said means for the transmission of motion and that is provided with an opening for the insertion of the oscillating arm.

6. A side element according to claim 1 characterized in that said casing is provided with a pair of seats for the insertion under pressure of stems for connecting to an opposite element of the irrigation device.

7. A side element according to claim 1, characterized in that said casing comprises two box-like parts that are fastened together by bolts.

8. A side element according to claim 1, characterized in that said external mouth is housed in a lateral niche of said casing.

9. A side element according to claim 1, characterized in that said rectlinear internal conduit is conical and has a cross-section that decreases from the mouth to the rotor.

10. A side driving element for an irrigation device with an oscillating sprinkling arm, comprising:

a casing having a bottom wall forming a flat resting plane arranged for sliding movement, a top wall and two side walls, the oscillating arm extending from one of the two side walls, a turbine rotor being housed inside said casing, the turbine rotor having an axis of rotation parallel to that of the oscillating arm of the irrigation device, said rotor driving the oscillating arm, and an external mouth extending from said casing in a position close to said resting plane for connecting a supply conduit of an irrigation liquid, said mouth having an axis parallel to said resting plane and orthogonal to the axis of rotation of the rotor, wherein irrigation liquid supplied by said supply conduit upon entering the mouth travels in a straight line to a point where the irrigation liquid impinges on the turbine rotor.

* * * * *